US007343861B1

(12) United States Patent
Baker

(10) Patent No.: US 7,343,861 B1
(45) Date of Patent: Mar. 18, 2008

(54) DEVICE AND METHOD FOR PRODUCING AN INFRARED EMISSION AT A GIVEN WAVELENGTH

(75) Inventor: James J. Baker, Waldorf, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 156 days.

(21) Appl. No.: 11/141,604

(22) Filed: May 31, 2005

(51) Int. Cl.
*F42B 4/26* (2006.01)
*F42B 4/06* (2006.01)

(52) U.S. Cl. ..... 102/336; 102/347; 244/1 TD

(58) Field of Classification Search ..... 102/336, 102/341, 342, 345, 347, 351, 357, 370; 89/1.11; 244/1 TD
See application file for complete search history.

(56) References Cited

U.S. PATENT DOCUMENTS

| | | | | |
|---|---|---|---|---|
| 3,150,848 | A * | 9/1964 | Lager | 244/3.16 |
| 3,459,129 | A | 8/1969 | Akhagen | 102/90 |
| 3,518,670 | A | 6/1970 | Miller | 343/18 |
| 4,171,669 | A | 10/1979 | Allen | 102/37.6 |
| 4,698,108 | A | 10/1987 | Vega et al. | 149/21 |
| 4,704,967 | A | 11/1987 | Milstead et al. | 102/334 |
| 4,719,856 | A | 1/1988 | Joslin | 102/335 |
| 4,728,375 | A | 3/1988 | Simpson | 149/5 |
| 4,756,778 | A | 7/1988 | Deitz et al. | 149/108.2 |
| 4,838,167 | A | 6/1989 | Prahauser et al. | 102/334 |
| 5,635,666 | A * | 6/1997 | Bannasch et al. | 102/334 |
| 5,656,794 | A | 8/1997 | Krone et al. | 149/108.2 |
| 5,992,327 | A | 11/1999 | Wardecki et al. | 102/334 |
| 6,168,677 | B1 | 1/2001 | Warren | 149/19.4 |
| 6,513,438 | B1 * | 2/2003 | Fegg et al. | 102/336 |
| 6,578,492 | B1 | 6/2003 | Koch et al. | 102/334 |
| 6,581,520 | B1 | 6/2003 | Koch et al. | 102/336 |
| 6,662,700 | B2 * | 12/2003 | O'Neill | 89/1.11 |
| 2002/0117242 | A1 | 8/2002 | Nielson et al. | 149/19.3 |
| 2003/0159427 | A1 | 8/2003 | Vickery et al. | 60/204 |
| 2004/0227112 | A1 | 11/2004 | Howard | 250/574 |

* cited by examiner

*Primary Examiner*—James S Bergin
(74) *Attorney, Agent, or Firm*—Fredric J. Zimmerman

(57) ABSTRACT

An infrared emitting device produces a certain heat emission. The device has a heat source for generating a specific amount of heat for heating inert material to a given temperature and expelling this heated material to form a cloud. The heated inert material produces an infrared emission for anti-missile operations.

19 Claims, 2 Drawing Sheets

DEVICE AND METHOD FOR PRODUCING AN INFRARED EMISSION AT A GIVEN WAVELENGTH

STATEMENT OF GOVERNMENT INTEREST

The invention described herein may be manufactured and used by or for the government of the United States of America for governmental purposes without the payment of any royalties thereon or therefore.

BACKGROUND OF THE INVENTION

1. Field of the Invention

The present invention pertains to producing IR emissions of a given wavelength for anti-missile defense.

2. Brief Description of the Related Art

Missiles track targets by detecting an infrared signal. Decoys for anti-air missiles (AAM) and anti-ship missiles (ASM) have been used to defeat this tracking. An infrared decoy is a countermeasure against heat-seeking, anti-ship missiles. In practice a decoy is deployed between the ship and the anti-ship missile during the search and acquisition phase of the missile's flight for the purpose of attracting the exclusive attention of the missile's homing guidance system. The decoys emit an infrared (IR) radiation, which may be deployed immediately after launch through the time it touches ground or floats on the water.

Liquid fueled, IR radiating decoys have been used that produce an IR plume, or signature after they have been launched, entered the water, and floated back to the surface. Other decoys produce an IR decoy plume immediately after launch. Generally these ASM decoy systems use activated metals to produce IR signatures immediately upon launch. Most present IR decoys use a combination of magnesium and Teflon to produce a bright light, which would overpower any other IR signal.

There is a need in the art for improvements in IR signature decoys. The present invention addresses this need and other needs.

SUMMARY OF THE INVENTION

The present invention includes an infrared emitting device having a certain heat emission composed of an effective amount of a heat source for generating a predetermined amount of heat and an effective amount of substantially inert material for infrared emission with heating from the heat source. The infrared emitting device may be used in combination with other infrared emitting devices, and is particularly useful in ship-launched or air-launched anti-missile devices.

The present invention also includes a method for emitting an infrared signal with a certain heat emission having the steps of providing an infrared emitting device having an effective amount of a heat source for generating a predetermined amount of heat and an effective amount of substantially inert material for infrared emission with heating from the heat source, and heating the substantially inert material with heat from the heat source effective to produce the certain heat emission. The method of the present invention results in an emitted infrared signal having a specific wavelength emission which may include multiple specific wavelength emissions when a plurality of devices having different substantially inert materials are combined.

In an exemplary embodiment, the present invention uses the reaction of a fuel and an oxidizer to heat inert or semi-inert particles to a specific temperature. The gaseous products of combustion propel these particles out of the device. The ratio of oxidizer to fuel is controlled to produce only the heat necessary to heat the particles to the chosen temperature. By adjusting the fuel to oxidizer ratio, the temperature of the particles can be controlled. If the reaction of fuel and oxidizer produces particulate matter, these particles would add to the IR signature.

DETAILED DESCRIPTION OF AN EMBODIMENT

The present invention allows the production of a tailored infrared signal at any wavelength that a seeker missile would detect and track in order to confuse the seeker and protect a target from attack. The present invention provides a device and method of producing an infrared emission at any wavelength, i.e., infrared emitting device having a certain heat emission. The present invention is easily tailored to a given temperature by calculating the heat required to heat a given choice of inert and/or semi-inert particles to a desired temperature. From that calculation, the amounts of a fuel and oxidizer are readily calculated. Additionally, the present invention provides a readily manufactured and operational device that allows use of several IR decoys at a time to confuse the seeker.

Figure 1:
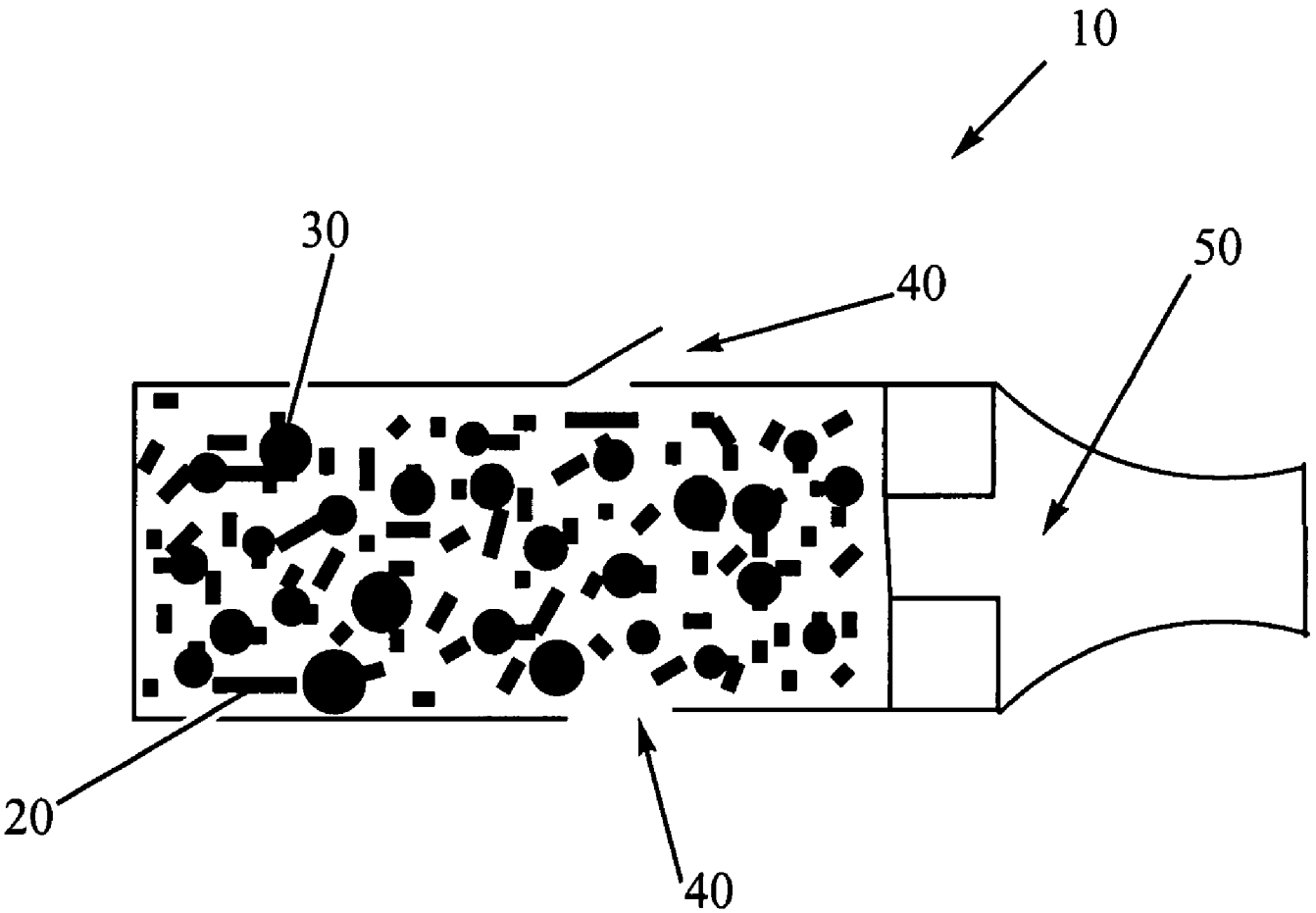
FIG. 1 illustrates cutaway side view of the device of the present invention; and, FIG. 2 illustrates an air deployment of the device shown in FIG. 1 for defeating target tracking by a missile.
Figure 2:
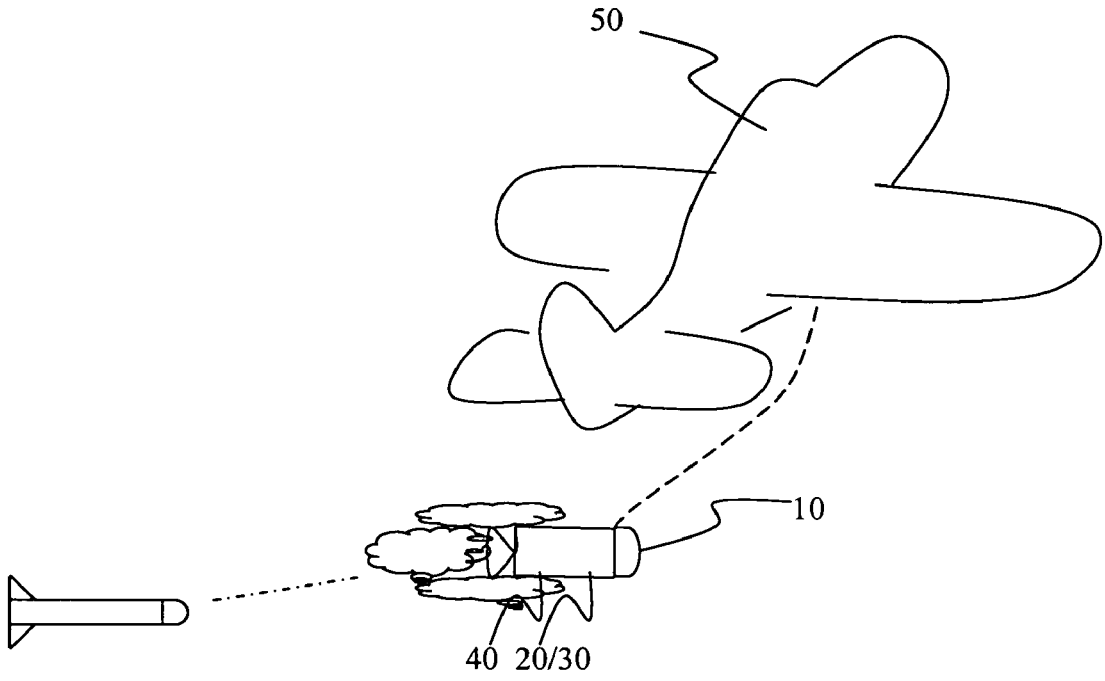

Referring to FIGS. 1 and 2, the device 10 of the present invention includes a heat source 20 and a heatable material 30, referred to herein as a substantially inert material. The heat source 20 includes any appropriate heating unit or chemical composition that allows the substantially inert material 30 to be heated to a given or certain temperature. The heat source 20 includes a reactive chemical composition that is present in an effective amount for generating a predetermined amount of heat. The heat source 20 includes a fuel and oxidizer combination, which are intermixed, either during burn or prior to burn, with the substantially inert material 30 to impart a given amount of heat to a given mass of the substantially inert material 30 to produce a resulting certain temperature. Representative heating amounts from the heat source 20 include about 50 calories to about 1000 calories of heat per gram of substantially inert material 30 present. Representative fuels and oxidizers include, for example without limitation, fuels of organic sugars, metal powders, organic polymers—both with curatives and without, esters and explosive compounds, such as RDX and dinitro-toluene and oxidizers of nitrates, nitrites, chlorates, perchlorates, peroxides, and bromates and combinations of fuels and oxidizers.

The substantially inert material 30 is present within the present invention in an effective amount of a given particulate matter for effective infrared emission with heating from the heat source 20. As such, enough substantially inert material 30 is present to provide decoy functionality, and is combined with the heat source 20 to achieve a given temperature during heating of the substantially inert material 30, e.g., during burn of the fuel/oxidizer. The substantially inert material 30 may include inert or semi-inert materials, and combinations of inert and semi-inert materials. The inert particles are chosen to provide a maximum black body radiation. Representative inert materials include refractory powders and ceramic powders, and combinations thereof, or other like incombustible powders, such as, silica, silica derivatives, titanium dioxide, aluminum oxide, and combinations thereof. For example, an inert material includes silica. Semi-inert materials include hard to ignite fuels or primers, such as, graphite, carbon black and boron powder, and combinations thereof. Representative temperatures of the heated substantially inert material 30 include the substantially inert material 30 heated to a temperature in a predetermined range of about 100° F. to about 600° F.

The infrared emitting device 10 of the present invention includes a dispersing mechanism 40 for dispersing the substantially inert materials 30, once heated, into the open environment to functionally perform as an IR emitter. Dispersing mechanisms 40 may include a fuel-oxidizer heat source 20, which is mixed with the substantially inert material 30 in a manner. Upon reacting forces, the substantially inert material 30, once heated, readily disperse into the environment. For example, the mixture may be confined in a vessel similar to a low-pressure rocket motor. The combustion of the fuel and oxidizer force particles out of a vent and into the atmosphere. A nozzle can be used for ensuring dispersal of the particles can be used. Representative dispersion dimensions of the heated substantially inert materials 30 includes a mean radius distance of greater than about one foot, such as, in a predetermined range from about 5 feet to about 25 feet, and, in particular, about 10 feet in radius. Dispersion patterns may include any appropriate configurations effective for anti-missile defense, such as, conical, oblong, spherical, etc., with spherical configurations preferred.

Powders, of the substantially inert material 30, of the present invention include those granular forms of a given solid chemical or chemical material that may be dispersed in separate units, generally in sizes having mean diameters of from about 0.001 μm to about 1 cm. Powders are generally free of water, or other agglomerating liquid substances.

In an exemplary embodiment, the infrared emitting device 10 of the present invention includes a propelling mechanism 50, such as a rocket, aircraft, launching device or other means, that moves the infrared emitting device 10 from a platform to another location prior to, or during, the heating of the substantially inert material 30, but prior to the dispersion of the heated material 30. Multiple units of the infrared emitting device 10 may be combined together on a single propelling mechanism 50, with the individual units set for simultaneous burn and dispersion once launched. Additionally, the compositions of the individual units may vary in types or amounts of heat source 20 and/or substantially inert material 30. As such, two separate units may be unique by varying the amount of heat source 20, e.g., the fuel/oxidizer ratio is changed, which produces a different emitted wavelength. Variations of the amount of substantially inert material 30 change the acquired resultant temperature of the substantially inert material 30, also changing wavelength. Changes in the intermixing of the heat source 20 and substantially inert material 30 alter the heating of the substantially inert materials 30 and resultant wavelength. Changes or combinations of substantially inert material 30 changes the IR signature, and may produce multiple certain wavelengths. A vast variety of combinations of fuel, oxidizer, and particulate matter may be used within the device 10 provided that intermixing and ratio amounts of the components are correctly calculated. In an exemplary embodiment, a plurality of infrared emitting devices 10 are included in a single device having at least two of the infrared emitting devices producing infrared radiation at different specific wavelengths.

The infrared emitting device of the present invention provides an effective anti-missile device for military use. In practice, emitting an infrared signal having a certain heat emission may include a single container for both the heat source 20 and substantially inert material 30, which is launched, such as, from a ship or aircraft platform, between an incoming missile and target. As the heat source 20 and substantially inert material 30 are co-located within a common container, the substantially inert material 30 is heated with release of heat from the heat source 20. Once the substantially inert material 30 is heated to a given temperature, it is dispersed from the container relative to the path of missile. The dispersed heated substantially inert material 30 emits a predetermined amount of energy for producing a certain heat emission.

EXAMPLE 1

Prophetic

A mixture of sugar (sucrose), potassium chlorate, and carbon black is made and placed in a container. The sugar functions as the fuel, potassium chlorate as the oxidizer, and carbon black as the semi-inert material. The ratios of the ingredients are chosen such that the sugar/chlorate reaction provides a desired amount of heat energy to heat the carbon black particles to a specific temperature. The steam and carbon oxides generated in the combustion reaction propel the carbon black particles out of the container.

The foregoing summary, description, and examples of the present invention are not intended to be limiting, but are only exemplary of the inventive features, which are defined in the claims.

Finally, the numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding techniques.

What is claimed is:

1. An infrared emitting device having a certain heat emission, comprising:

an effective amount of a heat source for generating a predetermined amount of heat;

an effective amount of substantially inert material for infrared emission with heating from the heat source;

a dispersing mechanism for dispersing the substantially inert material; and a propelling mechanism to move the infrared emitting device, wherein the heat source comprises a fuel and an oxidizer combination provided at a predetermined ratio.

2. The infrared emitting device of claim 1, wherein the substantially inert material is selected from at least one an inert and semi-inert materials.

3. The infrared emitting device of claim 2, wherein the inert materials are selected from at least one of refractory powders and ceramic powders.

4. The infrared emitting device of claim 2, wherein the inert material comprises silica.

5. The infrared emitting device of claim 2, wherein the semi-inert materials are selected from at least one of graphite, carbon black, and boron powder.

6. The infrared emitting device of claim 1, wherein the substantially inert materials comprise an inert material selected from at least one of silica, silica derivatives, titanium dioxide, and aluminum oxide.

7. The infrared emitting device of claim 1, wherein the propelling mechanism is a rocket.

8. The infrared emitting device of claim 1, wherein said substantially inert material is comprised of granules of inert material, said granules are in a predetermined mean diameter range of about 0.001 μm to about 1 cm.

9. The infrared emitting device of claim 1, wherein the heat source provides a predetermined range of about 50 calories to about 1000 calories of heat per gram of the substantially inert material present.

10. A multiple unit infrared emitting device, comprising:

a plurality of infrared emitting devices of claim 1, wherein at least two of the infrared emitting devices produce an infrared radiation at different specific wavelengths.

11. An anti-missile device, comprising:

an infrared emitting device of claim 1.

12. A ship launched device, comprising:

an infrared emitting device of claim 1.

13. An aircraft launched device, comprising:

an infrared emitting device of claim 1.

14. The infrared emitting device of claim 1, wherein the heat source is comprised of at least two different heat sources where each of said at least two different heat sources comprises a different fuel and oxidizer composition.

15. A method for emitting an infrared signal having a certain heat emission, comprising:

providing an infrared emitting device comprising an effective amount of a heat source for generating a predetermined amount of heat and an effective amount of substantially inert material for infrared emission with heating from the heat source;

heating the substantially inert material with heat from the heat source effective to produce a certain heat emission;

dispersing the substantially inert material by a dispersing mechanism; and moving the infrared emitting device by a propelling mechanism, wherein the heat source comprises a fuel and an oxidizer combination provided at a predetermined ratio.

16. The method of claim 15, wherein the heat source provides a predetermined range of about 50 calories to about 1000 calories of heat per gram of the substantially inert material present.

17. The method of claim 15, wherein the substantially inert material is heated to a temperature in a predetermined range of about 100° F. to about 600° F.

18. The method of claim 15, wherein the substantially inert materials are dispersed at a mean radius distance of about 10 feet.

19. The method of claim 15, wherein the substantially inert materials are dispersed in a predetermined mean radius distance range of about 5 feet to about 25 feet.

* * * * *